US007235959B2

(12) United States Patent
Sicard

(10) Patent No.: US 7,235,959 B2
(45) Date of Patent: Jun. 26, 2007

(54) LOW DROP-OUT VOLTAGE REGULATOR AND METHOD

(75) Inventor: Thierry Sicard, Tournefeuille (FR)

(73) Assignee: Freescale Semiconductor, Inc., Austin, TX (US)

( * ) Notice: Subject to any disclaimer, the term of this patent is extended or adjusted under 35 U.S.C. 154(b) by 0 days.

(21) Appl. No.: 10/519,306

(22) PCT Filed: Jun. 16, 2003

(86) PCT No.: PCT/EP03/06295

§ 371 (c)(1),
(2), (4) Date: Oct. 24, 2005

(87) PCT Pub. No.: WO2004/003674

PCT Pub. Date: Jan. 8, 2004

(65) Prior Publication Data

US 2006/0132107 A1 Jun. 22, 2006

(30) Foreign Application Priority Data

Jun. 28, 2002 (EP) ..... 02291605

(51) Int. Cl.
*G05F 3/16* (2006.01)

(52) U.S. Cl. ..... 323/316

(58) Field of Classification Search ..... 323/316, 323/317, 315

See application file for complete search history.

(56) References Cited

U.S. PATENT DOCUMENTS

| | | | | |
|---|---|---|---|---|
| 5,889,393 | A | 3/1999 | Wrathall | |
| 5,982,226 | A | 11/1999 | Rincon-Ora | |
| 6,225,857 | B1 | 5/2001 | Brokaw | |
| 6,300,749 | B1 | 10/2001 | Castelli | |
| 6,304,131 | B1 | 10/2001 | Huggins | |
| 6,340,918 | B2 | 1/2002 | Taylor | |
| 6,388,433 | B2 | 5/2002 | Marty | |
| 6,765,374 | B1 * | 7/2004 | Yang et al. | 323/280 |
| 6,806,773 | B1 * | 10/2004 | Simmons et al. | 330/292 |

* cited by examiner

*Primary Examiner*—Shawn Riley

(57) ABSTRACT

A low drop-out voltage regulator (300) and method comprising: a differential transistor arrangement (Q1–Q2) for receiving a reference voltage and in dependence thereon producing a regulatred output voltage; an output stage (Q3) for coupling to a load; and a control loop (310) coupled to the differential transistor arrangement for providing a dominant pole. Since a load capacitance is not used for dominant pole, stability of operation may be obtained with a lower load capacitance. The output stage is preferably a closed-loop unity gain amplifier providing a low impedance output. This provides the following advantages: 1—The output capacitor can be dramatically reduced or removed (a low dominant pole, allows the regulator to worth with 0nF output capacitor). 2—internal power consumption can be reduced, improving regulator efficiency. 3—Low output impedance is provided, with very low DC output resistance. 4—The load capacitor can have zero ESR (equivalent serial resistance).

21 Claims, 7 Drawing Sheets

LOW DROP-OUT VOLTAGE REGULATOR AND METHOD

FIELD OF THE INVENTION

This invention relates to voltage regulators, and particularly to low drop-out (LDO) voltage regulators.

BACKGROUND OF THE INVENTION

A low drop-out voltage regulator is a regulator circuit that provides a well-specified and stable DC voltage (whose input-to-output voltage difference is typically low). The operation of the circuit is based on feeding back an amplified error signal which is used to control output current flow of a pass device (such as a power transistor) driving a load. The drop-out voltage is the value of the input/output differential voltage where regulation is lost.

The low drop-out nature of the regulator makes it appropriate (over other types of regulators such as dc-dc converters and switching regulators) for use in many applications such as automotive, portable, and industrial applications. In the automotive industry, the low drop-out voltage is necessary during cold-crank conditions where an automobile's battery voltage can be below 6V. Increasing demand for LDO voltage regulators is also apparent in mobile battery operated products (such as cellular phones, pagers, camera recorders and laptop computers), where the LDO voltage regulator typically needs to regulate under low voltage conditions with a reduced voltage drop.

A typical, known LDO voltage regulator uses a differential transistor pair, an intermediate stage transistor, and a pass device coupled to a large (external) bypass capacitor. These elements constitute a DC regulation loop which provides voltage regulation.

For the (LDO) low drop-out voltage, generally in the closest known technology the load capacitor forms the dominant pole, and due to this the capacitor has to be specified with a minimum and maximum serial resistance. As the load is part of the regulation loop, it is possible for instability to be caused by such indeterminate factors as parasitic capacitance.

However, this approach has the disadvantage(s) that, since the load is part of the regulation loop:

- the LDO regulator typically needs an external capacitor in order to ensure stability.
- the loop DC gain changes versus the load resistance and the capacitor value
- the capacitor has to be specified with a minimum and maximum ESR (Equivalent Serial resistor)

A need therefore exists for a low drop-out voltage regulator in wherein the abovementioned disadvantage(s) may be alleviated.

STATEMENT OF INVENTION

In accordance with the present invention there is provided a low drop-out voltage regulator and a method for low drop-out voltage regulation as claimed in claim 1 and claim 12 respectively.

BRIEF DESCRIPTION OF THE DRAWINGS

One low drop-out voltage regulator, in which the load capacitor is not used "for dominant pole", incorporating the present invention will now be described, by way of example only, with reference to the accompanying drawings, in which.

DESCRIPTION OF PREFERRED EMBODIMENT

Figure 1:
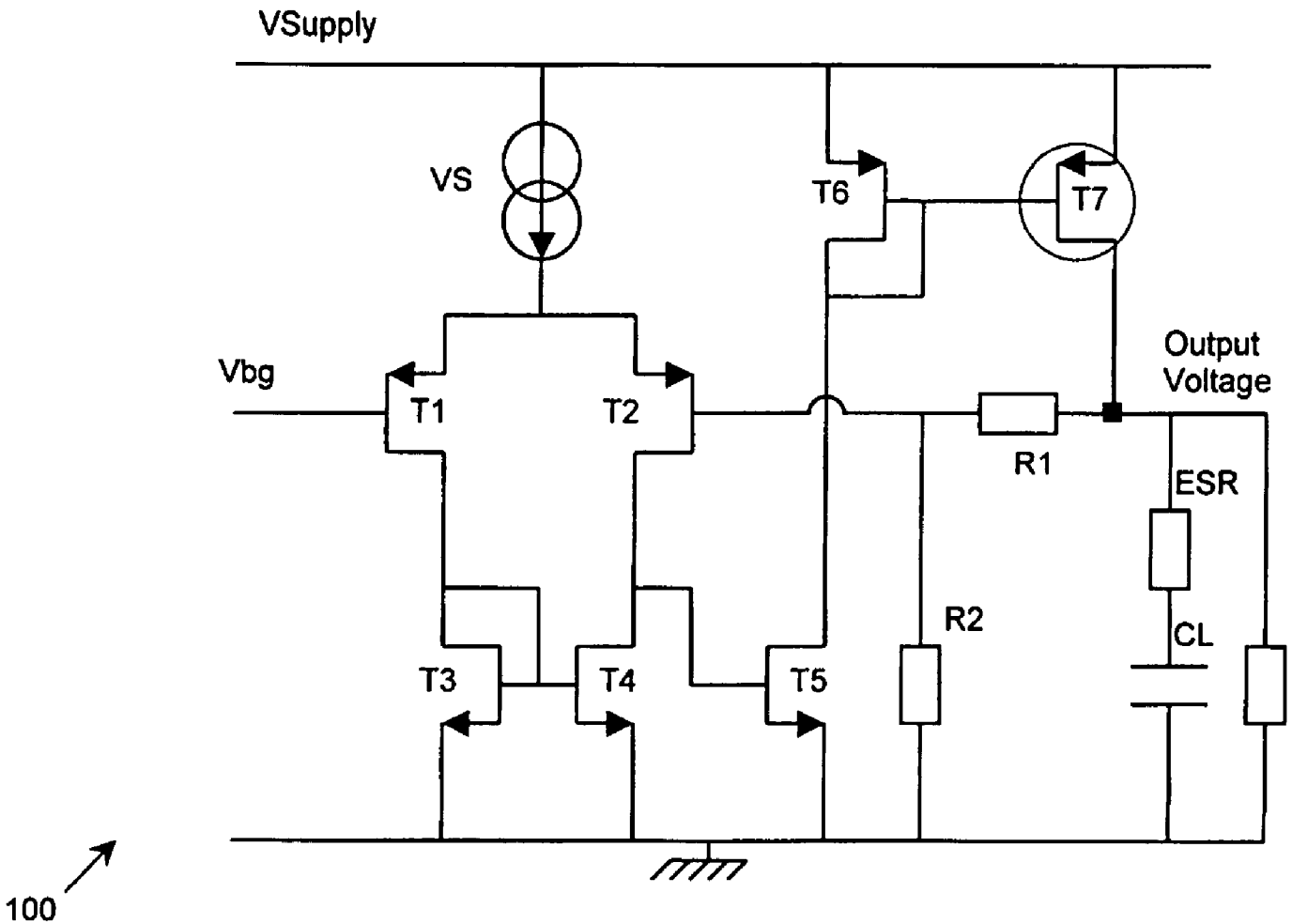
FIG. 1 Prior Art
FIG. 1 shows a schematic circuit diagram of a conventional LDO voltage regulator in which the output is high impedance and the load (and hence the load capacitor) are part of the voltage regulation loop.

Referring firstly to FIG. 1, a prior-art, conventional LDO voltage regulator (100) uses a differential transistor pair arrangement (T1–T4), an intermediate stage transistor arrangement (T5–T6), and a pass device (T7) coupled to a large (external) bypass capacitor (CL) having an equivalent series resistance (ESR). The differential transistor pair arrangement (T1–T4) receives a BandGap reference voltage (Vbg), and is supplied with a supply voltage (VSupply) through a voltage source (VS). These elements constitute a DC regulation loop which provides low drop-out voltage regulation of an Output Voltage applied to the external bypass/load capacitor (CL).

The bypass/output PMOS device (T7) allows a low drop-out voltage to be obtained between Supply and Output voltage, but as the output is made with the drain of the PMOS device (T7), the output is high impedance and the load (and hence the load capacitor) are part of the loop.

Since the load capacitor (CL) is used in the main loop of the regulator, the external capacitor (CL) will affect the stability of the loop due purely to its capacitance or too high a value of ESR.

Figure 2:
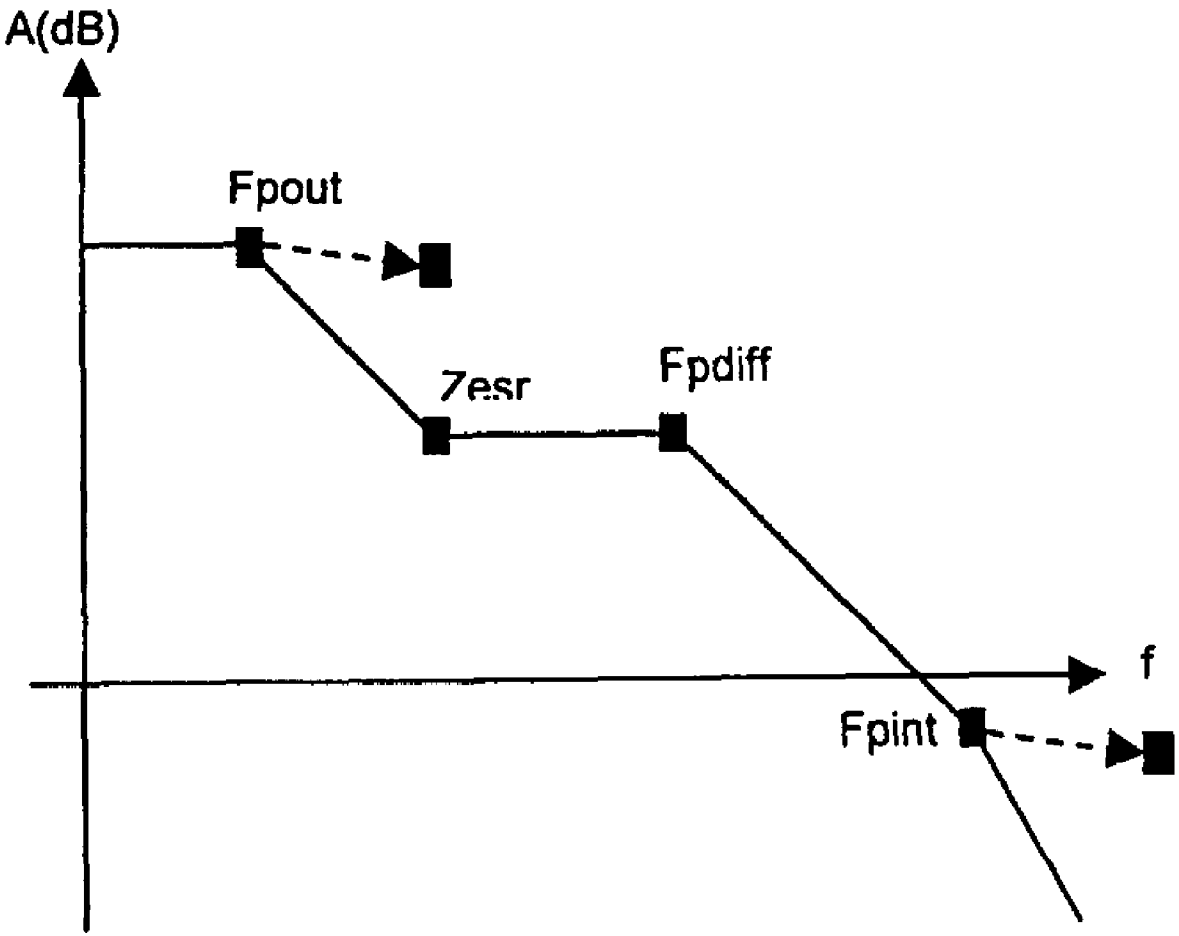
FIG. 2 Prior Art
FIG. 2 is a graph illustrating pole tracking behaviour of the circuit of FIG. 1.

Referring now also to FIG. 2, the plot of gain (A) of the voltage regulation loop against frequency (f) shows a dominant pole (Fpout) created by the output capacitor (CL), a zero (Zesr) created by the ESR of the output capacitor (CL), a further sub-dominant pole (Fpdiff) created by the differential pair arrangement (T1–T4) and a further sub-dominant pole (Fpin) created by the intermediate stage (T5–T6). It will be understood that the use in the intermediate stage of device T5 alone produces the plot shown in full line in FIG. 2, and that the use additionally of device T6 allows pole tracking of the poles Fpout and Fpin as shown by the arrowed dashed lines in the figure.

Figure 3:
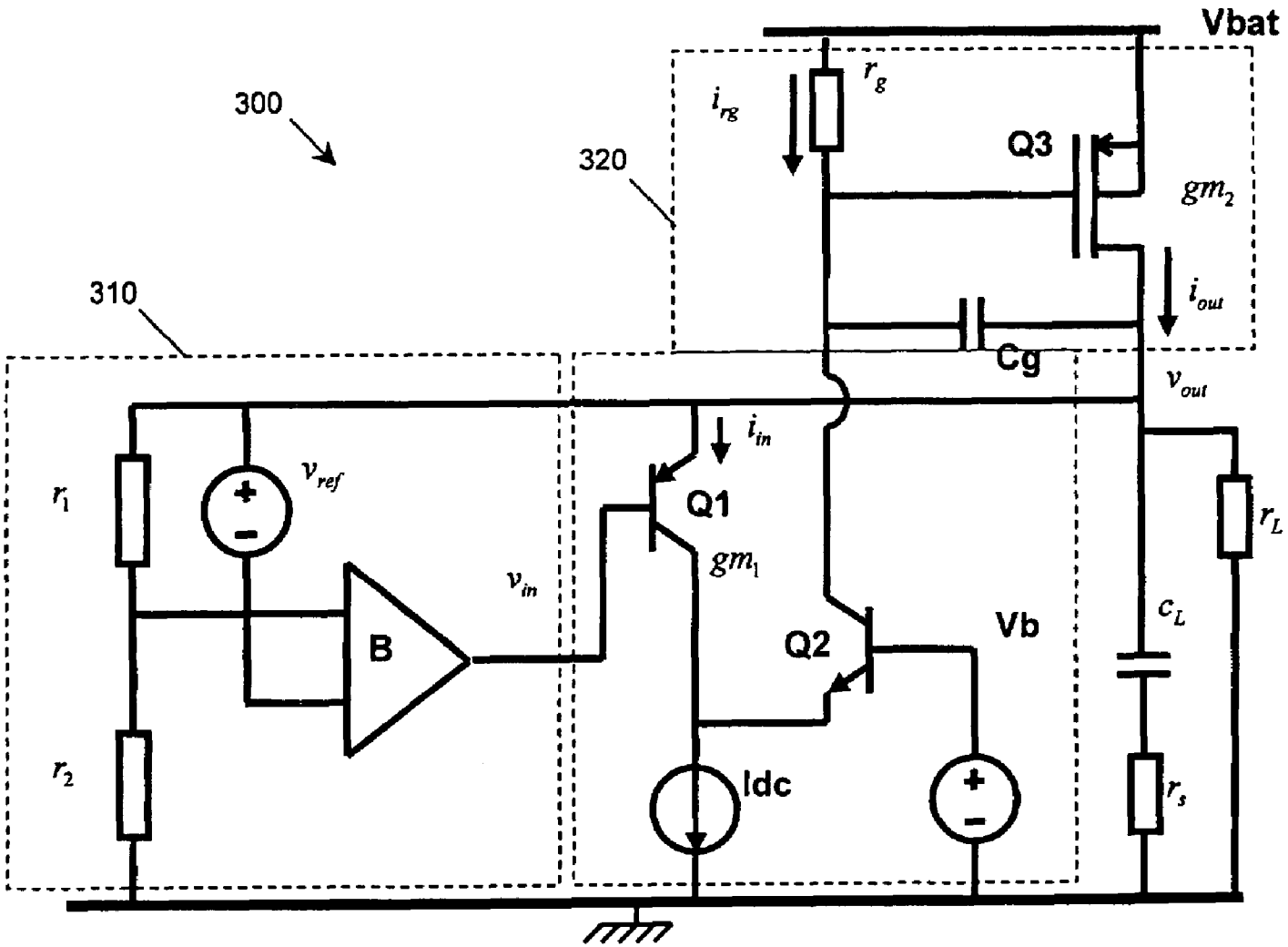
FIG. 3 shows a schematic circuit diagram of an LDO voltage regulator incorporating the present invention.

Referring now to FIG. 3, an improved LDO voltage regulator 300 has a differential amplifier B, whose inputs are respectively connected via a resistive divider $r_1$, $r_2$ and via a source of reference voltage $v_{ref}$ to an output node. The output of the differential amplifier B is connected to the base of a bipolar PNP transistor Q1, whose emitter is connected to the output node, and whose collector is connected via a source of DC current Idc to a ground rail. A cascoded bipolar NPN transistor Q2 has its emitter connected to the collector of transistor Q1, and has its base connected via a source of bias voltage Vb to the ground rail. The collector of the transistor Q2 is connected via a resistor $r_g$ to a rail of supply voltage Vbat. A PMOS transistor Q3 has its current electrodes connected between the supply rail and the output node, and has its control electrode connected to the collector of transistor Q2. Although the transistor Q3 is shown as an MOS device, it will be understood that a bipolar P-type transistor, i.e., a PNP device could alternatively be used. A capacitor Cg is connected between the output node and the collector of transistor Q2. The output node is connected to a load represented by a load capacitor $C_L$, a load resistor $r_L$ and a resistor $r_s$. It will be understood that the transistor Q3 is connected in 'common source' configuration, and has a non-unity open-loop gain which in closed-loop mode becomes a a unity gain since the output Vout is connected with the emitter of transistor Q1. In use of the LDO voltage regulator 300, an input voltage $v_{in}$ is developed at the output of the differential amplifier B, an input current $i_{in}$ flows into the emitter of the transistor Q1, a current $i_{rg}$ flows across the resistor $r_g$, and an input current $i_{out}$ flows from the transistor Q3 to the output node. It will be understood that the transistor Q1 has a transconductance $gm_1$ and the transistor Q3 has a transconductance $gm_2$.

The LDO voltage regulator circuit 300 can be considered in two parts:

- a 'main loop' 310 comprising the resistive divider $r_1$, $r_2$ and the differential amplifier B; and
- a 'follower impedance' 320 comprising the remaining components of FIG. 3 (as will be explained in more detail below, the 'follower impedance' provides an impedance adaptor providing a high input impedance and a low output impedance and a follower amplifier having closed-loop unity gain).

Figure 4:
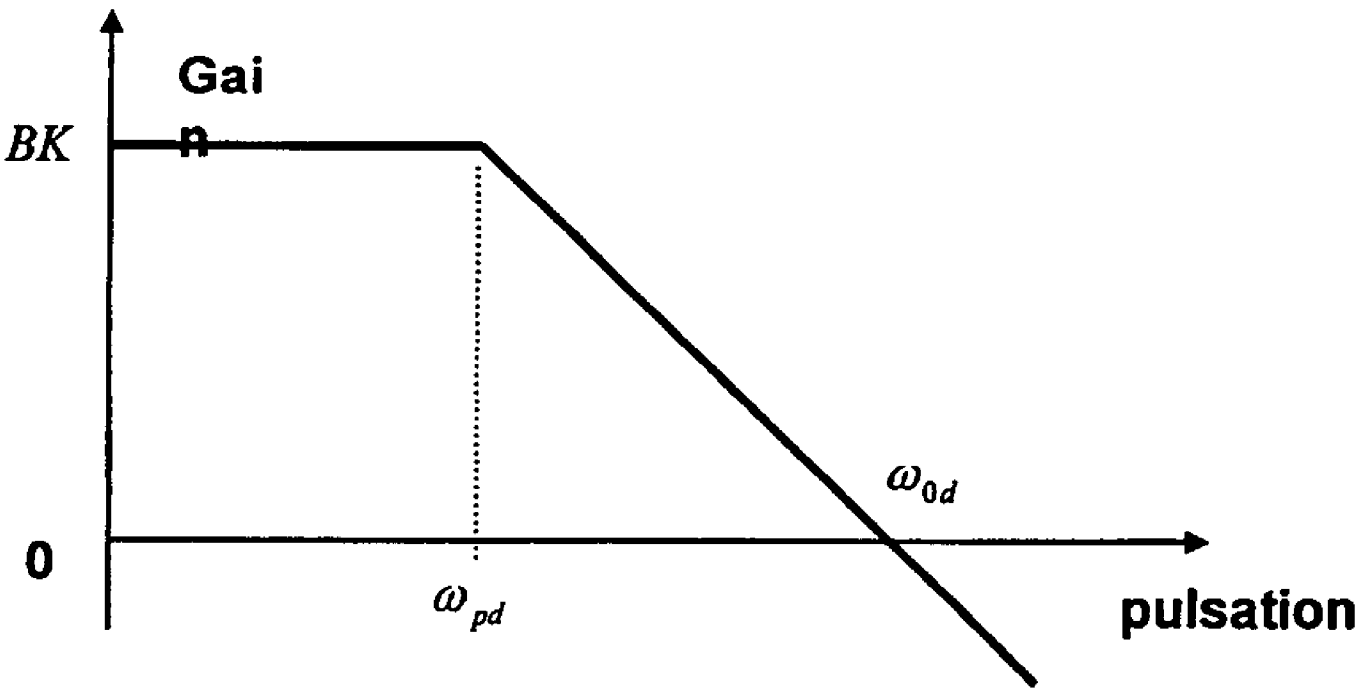
FIG. 4 is a graph illustrating operational behaviour of a main loop of the circuit FIG. 3.

Referring now also to FIG. 4, the open-loop operational behaviour of the 'main loop' 310, plotted as gain versus pulsation (frequency), shows that with increasing frequency the gain has a maximum value of BK (where B is the gain of the differential amplifier B, and $$K = \frac{r_1}{r_2 + r_1})$$

up to a dominant pole at frequency $\omega_{pd}$, (thereafter decreasing and crossing zero at a frequency $\omega_{0d}$). It can be shown that the ratio of $v_{in}$ and $v_{out}$, the open-loop gain $B_{OL}$, is given by:

$$\frac{v_{in}}{v_{out}} = B_{OL} = B \cdot K \frac{1}{1 + j\left(\frac{\omega}{\omega_{pd}}\right)}$$

Figure 5:
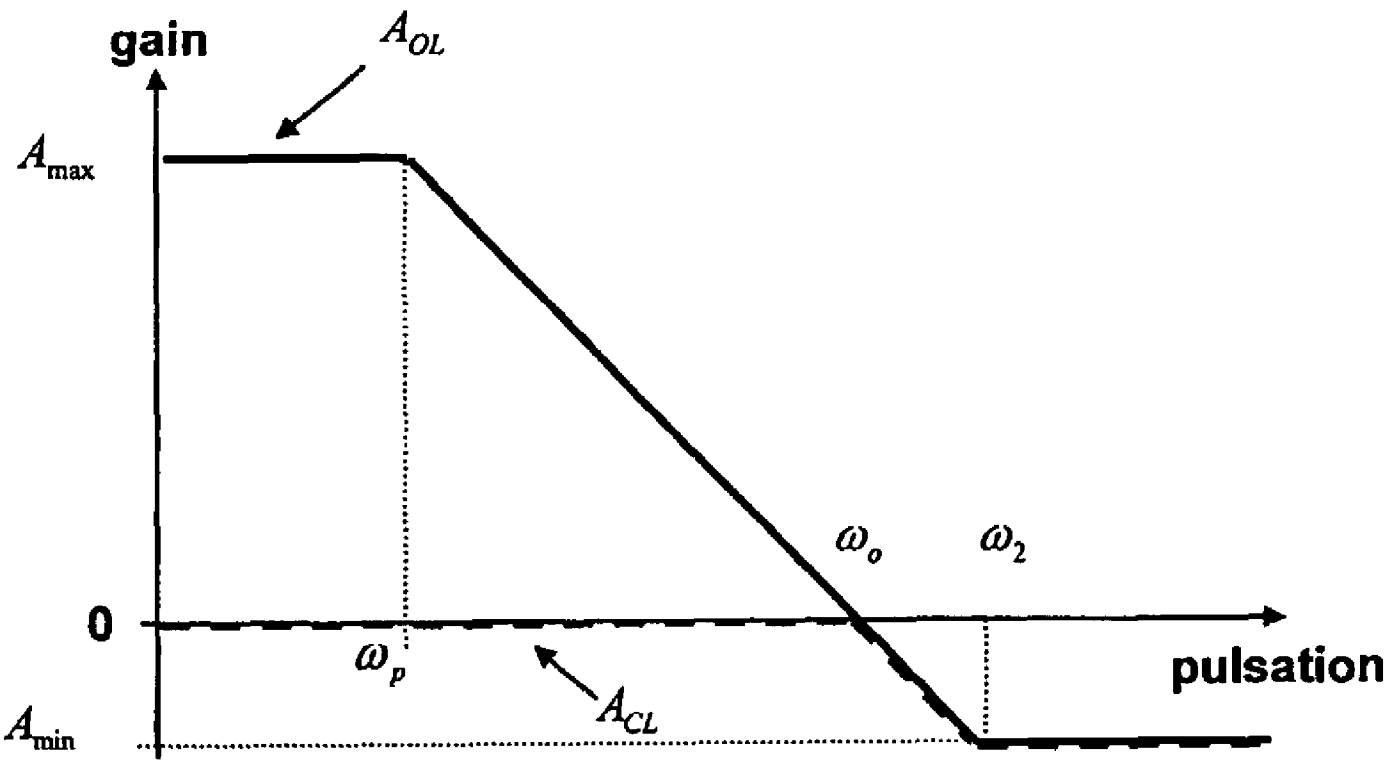
FIG. 5 is a graph illustrating operational behaviour of an impedance follower arrangement of the circuit portion of FIG. 3.

Referring now also to FIG. 5, the operational behaviour of the 'follower impedance' 320, plotted as open-loop gain $A_{OL}$ versus pulsation (frequency), shows that with increasing frequency the gain begins at a maximum value $A_{max}$, and decreases (starting at a pole at a frequency $\omega_p$, and ending at a pole at a frequency $\omega_2$, and crosses a zero value at a frequency $\omega_O$). It will be understood that the closed-loop gain $A_{CL}$ (shown in dashed line) of the 'follower impedance' 320 begins at a zero value up to the frequency $\omega_O$, and thereafter becomes the same as the open-loop gain $A_{OL}$, decreasing to the minimum value $A_{min}$ at the frequency $\omega_2$.

It can be shown that the open-loop gain $A_{OL}$ is given by:

$$A_{OL} = (G_i + 1) \cdot gm_1 \cdot r_L \left( \frac{1 + j\frac{\omega}{\omega_2}}{1 + j\frac{\omega}{\omega_p}} \right)$$

where $G_i = \frac{i_{out}}{i_{rg}}$, $\omega_p = \frac{1}{(r_L + r_S) \cdot c_L}$, $\omega_2 = \frac{1}{r_S \cdot c_L}$, $\omega_O = \frac{1}{\frac{r_e}{(G_i + 1)} \cdot c_L}$, $A_{max} = gm_1.(G_i+1).r_L$, and at high frequencies $$A_{\min} = \frac{r_S}{r_e}(G_i + 1),$$

and that the closed loop gain is given by:

$$A_{CL} = \frac{1}{1 + j\left(\frac{r_e \cdot c_L \cdot \omega}{G_i + 1}\right)}$$

where $r_e$, the dynamic impedance of the transistor Q1, is equal to $$\frac{1}{gm_1}.$$

It will be noted that the load impedance ($r_L$) appears in the open loop gain ($A_{OL}$), but not in the closed-loop gain ($A_{CL}$) where $V_{out}=V_{in}$. It will be understood that this results in DC output current not changing the closed-loop gain.

It will therefore be understood that in the LDO voltage regulator 300 transistor Q1 creates a low output impedance with an emitter follower, and the load capacitance is divided by the current gain of the second stage. Therefore, the pole created by the load capacitance is high, because RC is low (R low due to the emitter follower, C low due to the output capacitor's value being divided by, for example, 1000). The dominant pole is given by the amplifier compensation (main loop with amplifier B) and not dependant on the load (up to a load of, for example, 10 μF).

Figure 6:
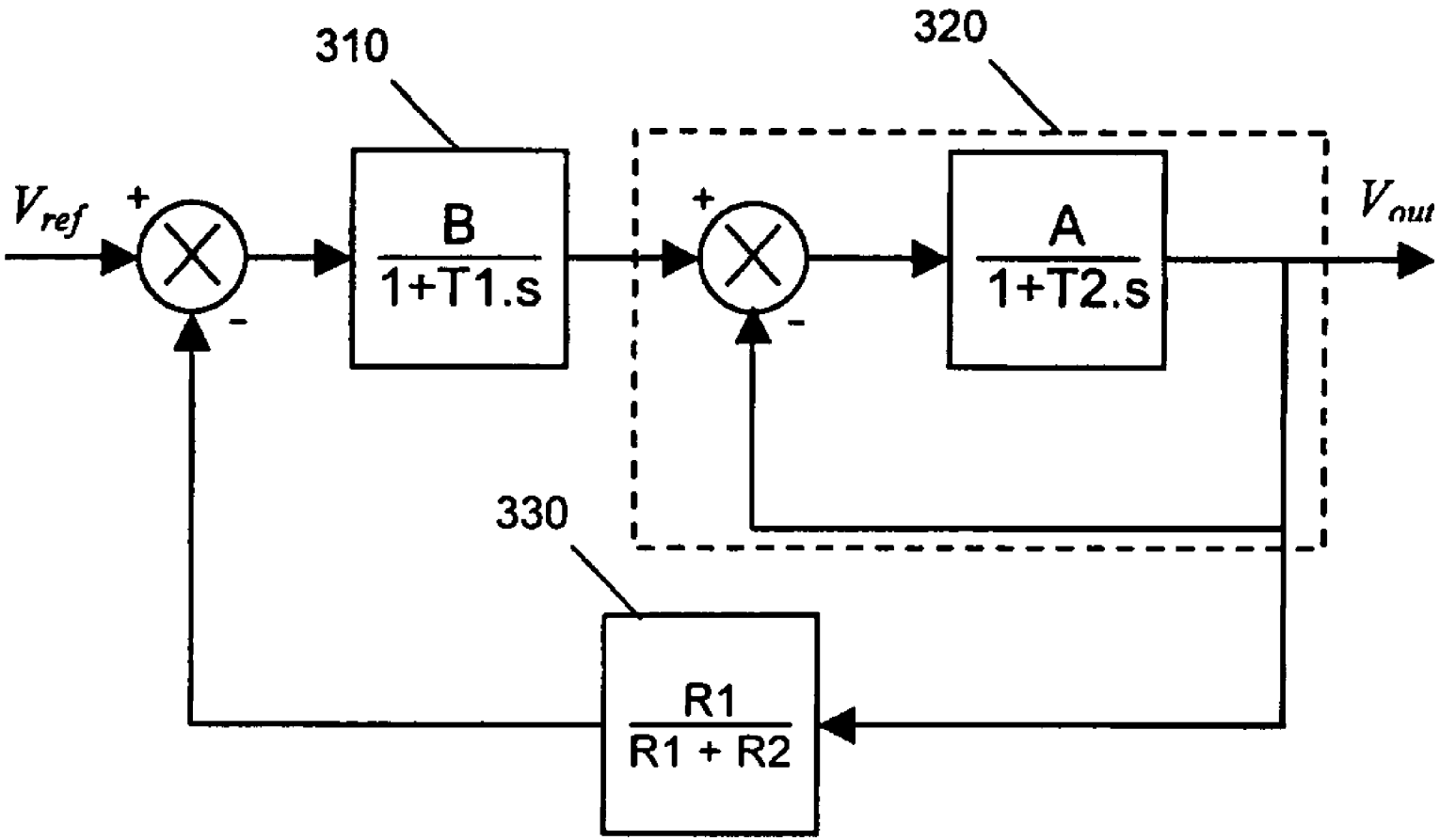
FIG. 6 shows a block-schematic representation of the LDO voltage regulator of FIG. 3.

Referring now also to FIG. 6, it will be appreciated that in a block diagrammatic representation the LDO voltage regulator 300 has a main loop 310 which contributes a dominant pole T1, an output loop provided by the 'follower impedance' 320 which contributes sub-dominant pole T2, and internal DC feedback 330. It will be understood that in the gains of the blocks 310 and 320 of FIG. 6, the symbol S represents the Laplace operator.

Figure 7:
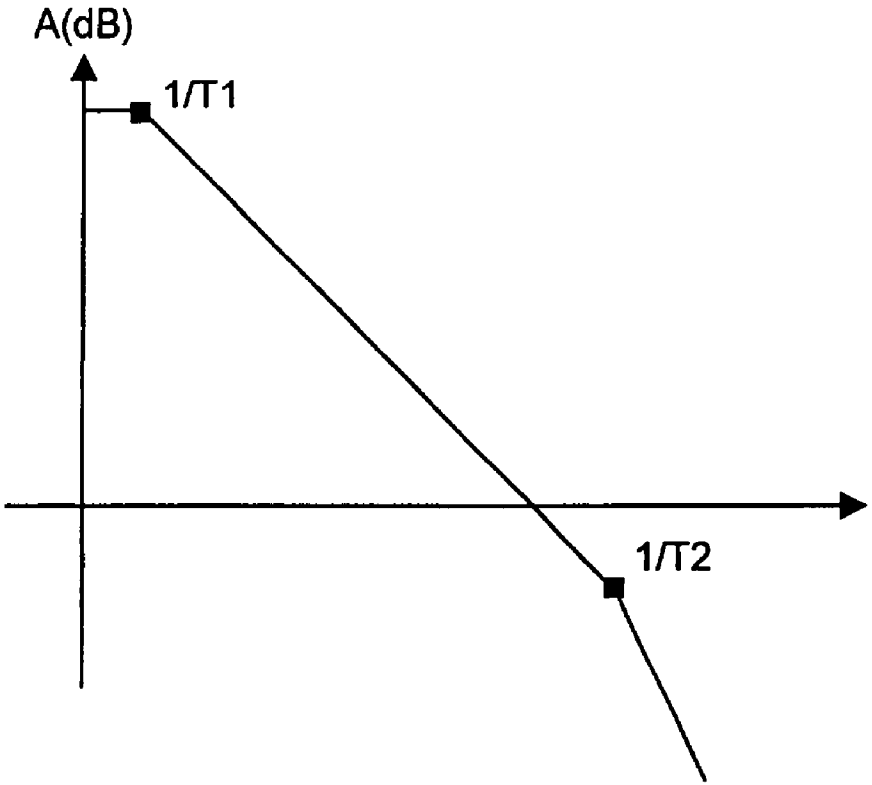
FIG. 7 is a graph illustrating operational behaviour of the circuit of FIG. 3.

Referring now also to FIG. 7, the cumulative effect of the poles T1 and T2 can be seen in the overall gain A of the regulation control loop in the LDO voltage regulator 300. As can be seen, the internal pole T1 provided by the amplifier B is a dominant, ultra-low pole. It can also be seen that no dominant pole is created by the output bypass capacitor CL, allowing strong stability for any capacitor used for this function. The pole created by CL (1/T2) appears when the gain is less than 1 and not before. Tests have shown that the LDO voltage regulator 300 exhibits good stability and low variation for a range of values of output capacitance.

It will be understood that the low drop-out voltage regulator where the load capacitor is not used "for dominant pole" described above provides the following advantages:

1. The output capacitor can be dramatically reduced in size, or may be removed (a low dominant pole, provided by the main loop with amplifier B, allows the LDO voltage regulator 300 to work with a 0nF output capacitor).
2. Internal power consumption can be reduced (for example, 100 μA may be enough to drive the full output current, up to 100 mA current limit), providing improved regulator efficiency.
3. Low output impedance is produced (the DC output resistance is very low, less than 10 mΩ, for example).
4. The external capacitor can have a ESR (equivalent serial resistor) of zero.

It will be understood that the low voltage drop-out regulator 300 will typically be fabricated in an integrated circuit (not shown).

It will be further appreciated that other alternatives to the embodiment of the invention described above will be apparent to a person of ordinary skill in the art. For example, the PMOS transistor Q3 may be cascoded to increase the output impedance in order to improve line transient performance of the LDO regulator.

The invention claimed is:

1. A low drop-out voltage regulator comprising:

transistor means for receiving a reference voltage and in dependence thereon producing a regulated output voltage, the transistor means having an output stage for coupling to a load; and control loop means coupled to the transistor means for providing a dominant pole; wherein the transistor means further comprises at least part of output loop means, the output loop means providing a low output impedance for coupling across the load so as to provide stability of operation by lowering a capacitance of the load.

2. The low drop-out voltage regulator as claimed in claim 1 wherein the control loop means comprises:

differential amplifier means having an output coupled to the transistor means; and voltage divider means coupled between the voltage regulator output and a first input of the differential amplifier means.

3. The low drop-out voltage regulator as claimed in claim 2 wherein the control loop means further comprises:

voltage reference means coupled between the voltage regulator output and a first input of the differential amplifier means.

4. The low drop-out voltage regulator as claimed in claim 1 wherein the output stage comprises a low impedance output.

5. The low drop-out voltage regulator as claimed in claim 1 wherein the output loop means is coupled to the voltage regulator output and the control loop means.

6. The low drop-out voltage regulator as claimed in claim 1 wherein the output loop means has a unity direct current (DC) gain.

7. The low drop-out voltage regulator as claimed in claim 1 wherein the transistor means comprises a cascode transistor arrangement.

8. The low drop-out voltage regulator as claimed in claim 1 wherein the output stage comprises a cascode transistor arrangement.

9. The low drop-out voltage regulator as claimed in claim 1 wherein the output stage comprises a P-type transistor.

10. The low drop-out voltage regulator as claimed in claim 9 wherein the P-type transistor is a PMOS transistor.

11. A method for low drop-out voltage regulation comprising:

providing transistor means receiving a reference voltage and in dependence thereon producing a regulated output voltage, the transistor means having an output stage for coupling to a load; and providing control loop means coupled to the transistor means for providing a dominant pole; wherein the transistor means further comprises at least part of output loop means, the output loop means providing a low output impedance for coupling across the load so as to provide stability of operation by lowering a capacitance of the load.

12. The method for low drop-out voltage regulation as claimed in claim 11 wherein the control loop means comprises:

differential amplifier means having an output coupled to the transistor means; and voltage divider means coupled between the voltage regulator output and a first input of the differential amplifier means.

13. The method for low drop-out voltage regulation as claimed in claim 12 wherein the control loop means further comprises:

voltage reference means coupled between the voltage regulator output and a first input of the differential amplifier means.

14. The method for low drop-out voltage regulation as claimed in claim 11 wherein the output stage comprises a low impedance output.

15. The method for low drop-out voltage regulation as claimed in claim 11 wherein the output loop means is coupled to the voltage regulator output and the control loop means.

16. The method for low drop-out voltage regulation as claimed in claim 11 wherein the output loop means has a unity direct current (DC) gain.

17. The method for low drop-out voltage regulation as claimed in claim 11 wherein the transistor means comprises a cascode transistor arrangement.

18. The method for low drop-out voltage regulation as claimed in claim 11 wherein the output stage comprises a cascode transistor arrangement.

19. The method for low drop-out voltage regulation as claimed in claim 11 wherein the output stage comprises a P-type transistor.

20. The method for low drop-out voltage regulation as claimed in claim 19 wherein the P-type transistor is a PMOS transistor.

21. An integrated circuit comprising the low drop-out voltage regulator of claim 1.

* * * * *